US006461176B1

(12) United States Patent
Haas

(10) Patent No.: US 6,461,176 B1
(45) Date of Patent: Oct. 8, 2002

(54) POWER CONTROL DEVICE

(76) Inventor: Norman C. Haas, 11408 Robinson, Overland Park, KS (US) 66210

( * ) Notice: Subject to any disclaimer, the term of this patent is extended or adjusted under 35 U.S.C. 154(b) by 0 days.

(21) Appl. No.: 09/507,803

(22) Filed: Feb. 22, 2000

(51) Int. Cl.[7] ..... H01R 13/44
(52) U.S. Cl. ..... 439/133; 200/33
(58) Field of Search ..... 439/133, 304; 200/42, 44, 33, 51.1

(56) References Cited

U.S. PATENT DOCUMENTS

| | | | | |
|---|---|---|---|---|
| 2,773,416 | A | 12/1956 | Kleinerman | 88/16.2 |
| 2,777,023 | A | 1/1957 | Sepulveda | 200/42 |
| 3,691,327 | A | 9/1972 | Chesler | 200/42 |
| 3,833,779 | A | 9/1974 | Leone | 200/33 |
| 4,167,658 | A | 9/1979 | Sherman | 200/44 |
| 4,247,743 | A | 1/1981 | Hinton et al. | 200/44 |
| 4,969,833 | A | 11/1990 | Lindow et al. | 439/133 |
| 5,061,199 | A | 10/1991 | McClead | 439/304 |
| 5,070,219 | A | 12/1991 | Grosskrueger et al. | 200/43.008 |
| 5,071,360 | A | 12/1991 | Lindow et al. | 439/133 |
| 5,120,236 | A | 6/1992 | Gilbert | 439/133 |
| 5,193,665 | A | 3/1993 | Jankow | 200/43.8 |
| 5,338,218 | A | 8/1994 | Haas | 439/346 |
| 5,479,800 | A | 1/1996 | Myers | 70/365 |
| 5,551,884 | A | 9/1996 | Burkhart, Sr. | 439/140 |
| 5,791,931 | A | 8/1998 | Burkhart, Sr. | 439/346 |
| 5,893,772 | A | 4/1999 | Carmo et al. | 439/346 |
| 5,911,586 | A | 6/1999 | Wintergerst | 439/133 |

FOREIGN PATENT DOCUMENTS

| | | |
|---|---|---|
| GB | 2126805 | 3/1984 |

*Primary Examiner*—Tulsidas Patel
(74) *Attorney, Agent, or Firm*—Lathrop & Gage, L.C.

(57) ABSTRACT

A power control device has a first contact, a second contact, and a third contact aligned within slots of a housing. A cam having arms is aligned with a cylinder of a key lock assembly. The key lock assembly and cam are mounted in the housing. An electrical connector having electrical leads is mounted in an aperture within the housing so that the leads of the electrical connector are connected to the first contact and the third contact. The cylinder of the key lock assembly may be rotated, thereby rotating the cam. The arms of the cam cause locking pins on the first and second contacts to engage apertures of an electrical device plug plugged into the receptacle of the housing. Simultaneously, a lug on the cam operates on the third contact to force the third contact out of electrical connection with the second contact, thereby eliminating the current flow to the electrical device plug.

43 Claims, 7 Drawing Sheets

236
246
238

236
234
230
240
242
238

230
234
246
242
238

240
238
242
246
244
236
234
230
232
122

248
254
264
262
250
256
252

250
266
264
260
254
258
252
262

110
262
256
252
254
264
268
266
248
260
258

POWER CONTROL DEVICE

FIELD OF THE INVENTION

The present invention relates to the field of a power supply control device for selectively disabling current flow through the device.

BACKGROUND OF THE INVENTION

It is desirable to have an inexpensive and convenient device that is operable to prevent unauthorized use of electrical appliances and other electrical devices. Such a power control device could be used with television sets, radios, power tools, and other electrical devices to interrupt the power to the electrical device and prevent an unauthorized user from plugging the electrical device into an electrical receptacle other than the power control device, thereby circumventing the effectiveness of the power control device. Therefore, an improved power control device is needed that is simple, convenient, inexpensive to manufacture, easy to use, and effective at preventing unauthorized use of an electrical device.

SUMMARY OF THE INVENTION

The present invention is directed to a power control device comprising a first lead and a second lead adapted to be electrically connected to an electrical source. A first contact having a first locking tip is electrically connected to the first lead. A second contact has a second locking tip. A third contact is electrically connected to the second lead. A cam is adapted to cause the third contact to move into electrical connection with the second contact and out of electrical connection with the second contact. The cam further is adapted to operate and to not operate on the first contact and the second contact. The first locking tip is adapted to engage a first aperture of an electrical device plug when the cam operates on the first contact and to disengage the first aperture when the cam does not operate on the first contact. The second locking tip is adapted to engage a second aperture of the electrical device plug when the cam operates on the second contact and to disengage the second aperture when the cam does not operate on the second contact.

DETAILED DESCRIPTION OF THE PREFERRED EMBODIMENTS

The present invention provides a device for conveniently controlling the supply of power to an electrical device. The power control device of the present invention minimizes the number of parts, particularly the number of moving parts, so that the power control device is inexpensive to manufacture, more reliable, and less likely subject to malfunction. The power control device provides a high degree of reliability for enabling or disabling power supplied to an electrical device.

In addition, the power control device may be provided with an electrical connector or cord having electrical leads connected to a plug that may be plugged into an electrical receptacle. This would allow the power control device to be operable a distance from the electrical receptacle. Thus, if the electrical receptacle is located behind furniture or in another location that is not readily or conveniently accessible, the power control device may be operable in a more readily accessible location. Alternately, an electrical plug may be mounted or molded into the housing of the power control device.

The power control device is key-operable for easy and secure usage. The key operated power control device is operable to lock the plug of the electrical device into the housing of the power control device and to stop power from flowing to the electrical device plug. Therefore, the power control device is easy to use and effectively and securely eliminates unauthorized usage of the electrical device.

Figure 1:
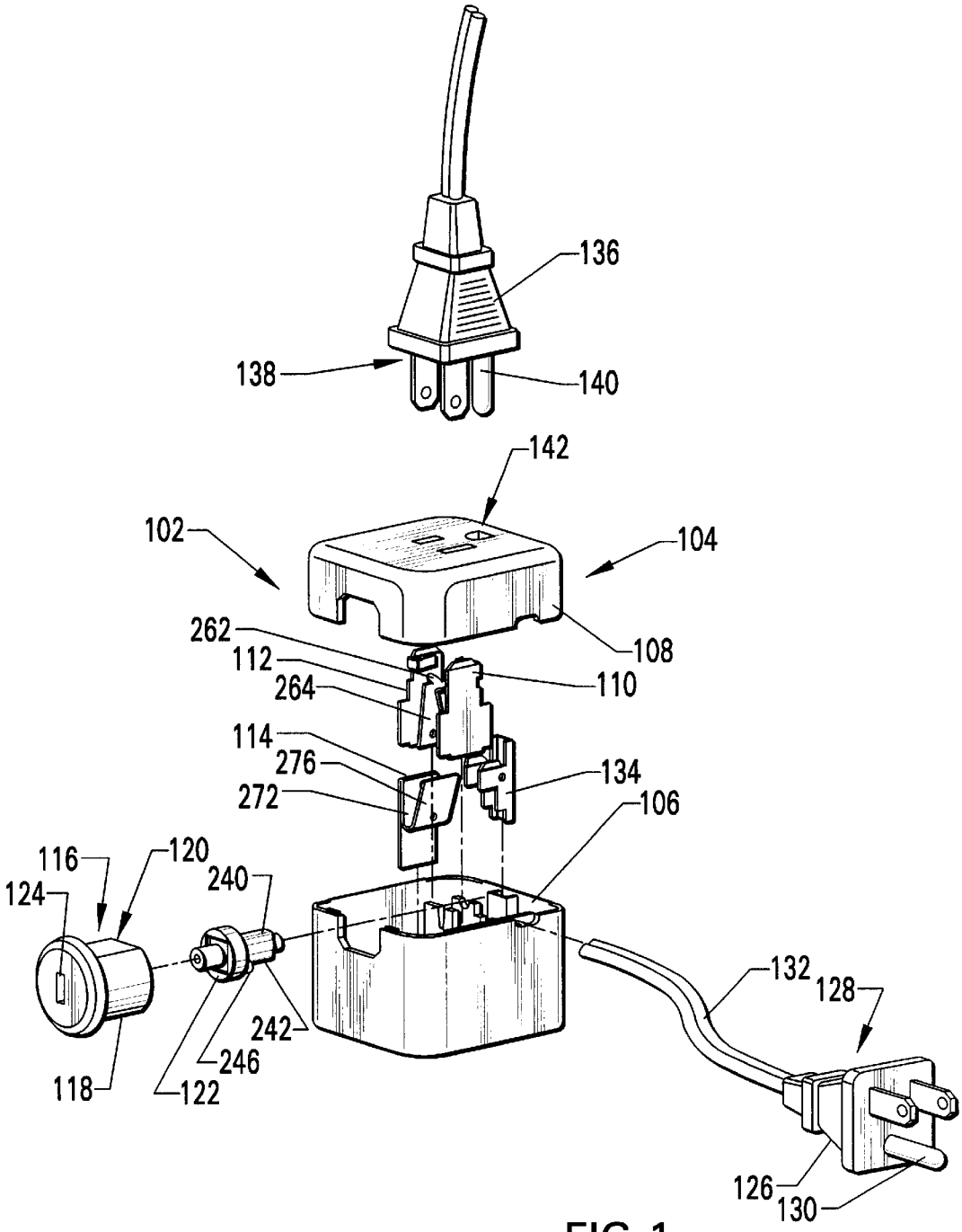
FIG. 1 is an exploded view of a power control device in accordance with an embodiment of the present invention.

FIG. 1 illustrates an exemplary embodiment of the power control device 102 of the present invention. The power control device 102 comprises a housing 104 having a first section 106 and a second section 108. A first contact 110, a second contact 112, a third contact 114, and a key lock assembly 116 are fitted into the housing 104 so that the key lock assembly is operable to enable or disable current flowing between the contacts 110–114. The key lock assembly 116 has a cylinder housing 118 with a cylinder 120 that is operable to rotate a cam 122 when a key (not shown) is inserted into the key opening 124 and turned.

The power control device 102 may be fit with a plug 126 having current conducting prongs 128. The plug 126 optionally may have a ground prong 130. Preferably, the power control device 102 plug 126 has an electrical connector 132, such as a cord, to connect the plug to the first contact 110, the third contact 114, and the ground contact 134. The electrical connector 132 would have electrical leads connecting the first contact 110, the third contact 114, and the ground contact 134 to the prongs 128 and 130 of the plug 126. Alternately, the plug 126 may be mounted or molded into the housing 104 without the electrical connector 132 so that the prongs 128 and 130 of the plug are connected by electrical leads or other connectors to the first contact 110, the third contact 114, and the ground contact 134 within the housing. Thus, the electrical leads go to the electrical source via the prongs 128 and 130 of the plug 126.

It will be appreciated that the electrical connector 132 can be of any desirable length. In some embodiments, one or more of the ground prong 130, the ground contact 134, and a ground lead may be eliminated from the power control device 102.

Figure 20:
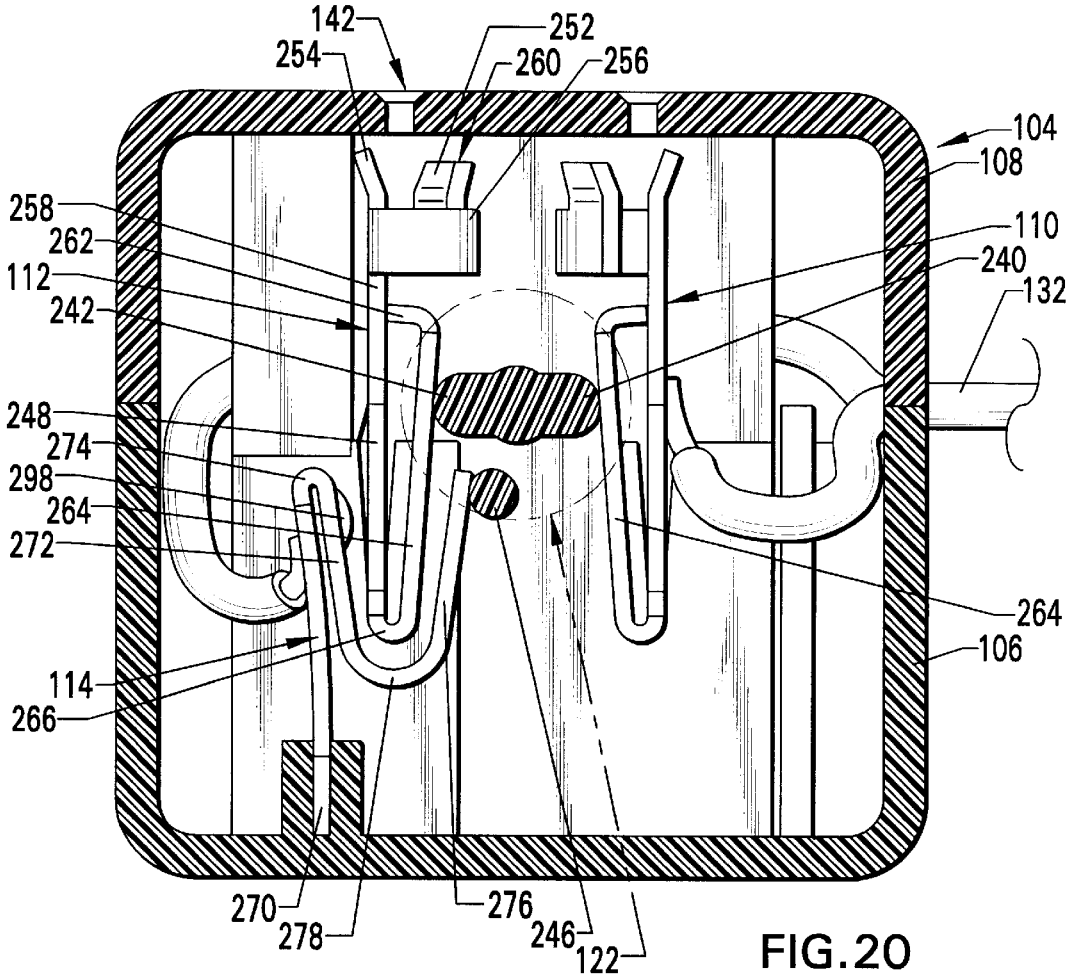
FIG. 20 is a cross sectional view of the power control device of FIG. 1 with the cam operating on the third contact.

In operation, an electrical device plug 136, such as an electrical appliance plug, having prongs 138 and an optional ground prong 140, is inserted into the receptacle 142 of the housing 104. The plug 126 of the power control device 102 is plugged into an electrical receptacle from which electrical current may flow. The key lock assembly 116 is rotated using a key (not shown) to enable or to disable current flow between the contacts 110–114, thereby allowing or not allowing current to flow to the electrical device plug 136. See FIGS. 20–21.

The power control device 102 also is operable to lock the electrical device plug 136 into the housing 104 so that the electrical device plug may not be removed from the housing. The electrical device plug 136 is locked into the housing 104 at the same time that the current flow is disabled between the contacts 110–114 when the cylinder 120 of the key lock assembly 116 is turned. The electrical device plug 136 is unlocked from the housing at the same time that current flow is enabled between the contacts 110–114 when the cylinder 120 of the key lock assembly 116 is turned. See FIGS. 20–21.

Figure 3:
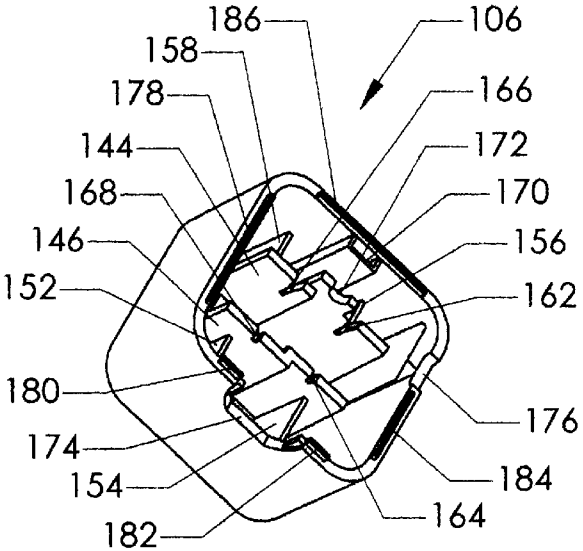
FIG. 3 is a rotated view of the first section of the housing of FIG. 2.
Figure 2:
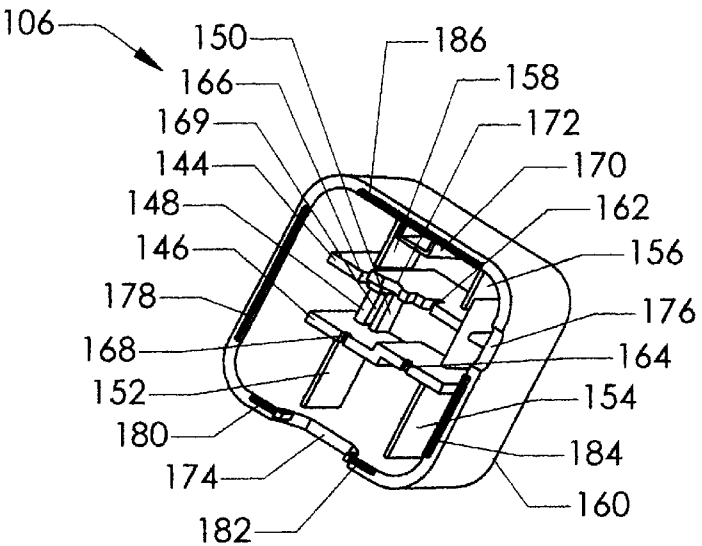
FIG. 2 is a perspective view of a first section of the housing of the power control device of FIG. 1.
Figure 4:
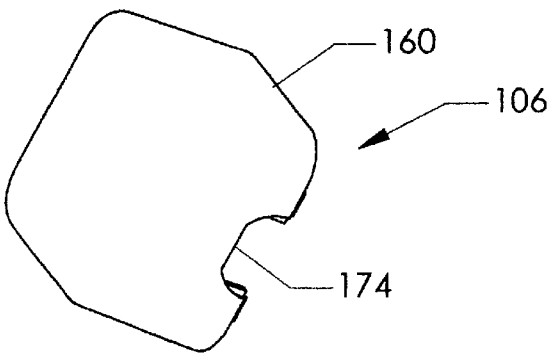
FIG. 4 is a rotated view of the first section of the housing of FIG. 2.

FIGS. 2–4 illustrate more detailed views of the first section 106 of the housing 104. The first section 106 can be made of any suitable insulating or electrically non-conducting material, such as a plastic or fiber glass material. Other insulating or non-conducting materials may be used. Alternately, the first section 106 can be formed of a metal or other electrically conducting material with an insulating or other electrically non-conducting material between the contacts 110–114 and the first section so that a short circuit is not created.

The first section 106 has ribs 144–150 to support and hold the contacts 110–114 and support walls 152–158 to provide support between the ribs 144–150 and the perimeter wall 160 of the first section. The ribs 144–146 have slots 162 and 164, respectively, that support and hold the first contact 110 in the first section 106. Additionally, the ribs 144 and 146 have slots 166 and 168, respectively, to support and hold the second contact 112 in the first section 106. The ribs 148 and 150 have a slot 169 therebetween that supports and holds the third contact 114 in the first section 106.

A guide wall 170 supports and holds an end of the optional ground contact 134 in the first section 106 of the housing 104. An end of the ground contact 134 is placed inside the guide wall 170 so that an end of the ground contact is surrounded by the guide wall and a portion of the perimeter wall 160.

The rib 144 has a groove 172 to support an end of the cam 122. The perimeter wall 160 of the first section 106 has a key lock assembly aperture 174 to hold the key lock assembly 116 in the first section 106 and a connector aperture 176 through which the electrical connector 132 is placed. If the power control device 102 is modified so that an electrical connector 132 is not used, and, instead, the plug 126 is mounted or molded into the housing 104, then the connector aperture 176 will be modified to support the plug 126. Tabs 178–186 are used to engage the first section 106 to the second section 108 of the housing 104.

Figure 6:
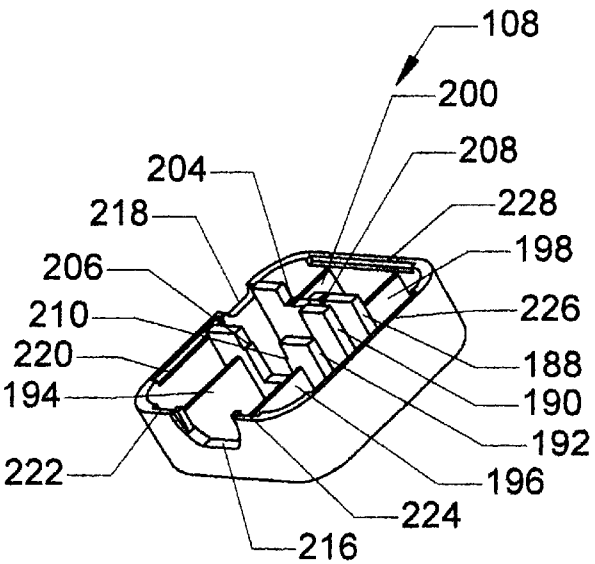
FIG. 6 is a perspective view of the second section of the housing of FIG. 5.
Figure 7:
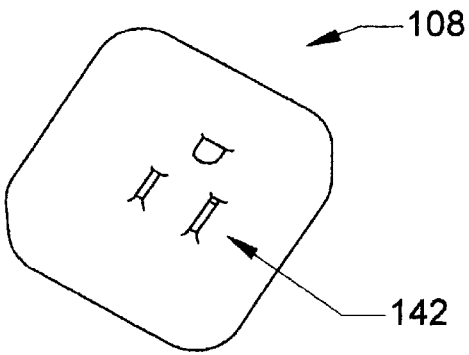
FIG. 7 is a rotated view of the second section of the housing of FIG. 5.
Figure 5:
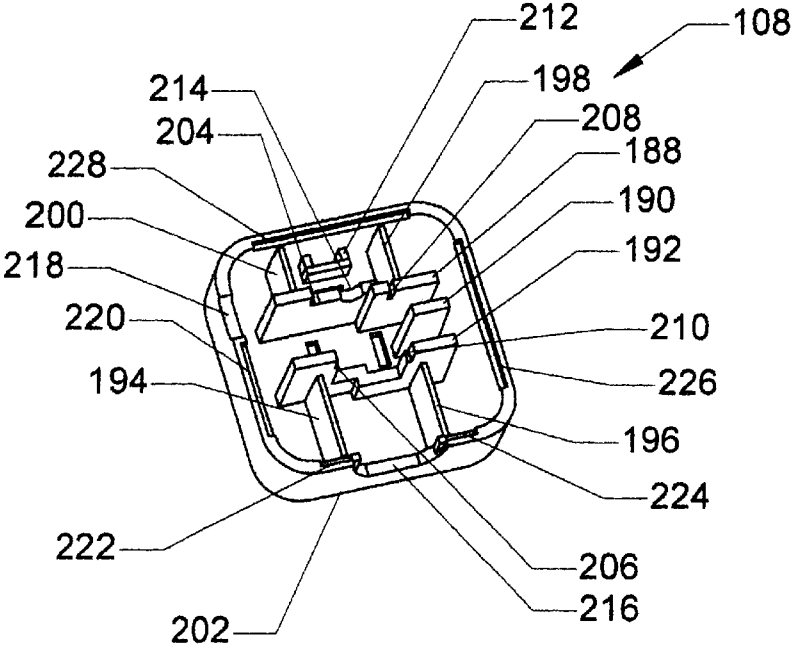
FIG. 5 is a view of a second section of the housing of the power control device of FIG. 1.

FIGS. 5–7 illustrate more detailed views of the second section 108 of the housing 104. The second section 108 may be made of any suitable insulating or electrically non-conducting material, such as a plastic or fiber glass material. Other insulating or non-conducting materials may be used. Alternately, the second section 108 may be made of a metal or other electrically conducting material with an insulating or other electrically non-conducting material between the contacts 110–114 and the second section so that a short circuit is not created.

The second section has ribs 188–192 to support and hold the contacts 110–114. Support walls 194–200 provide support between the ribs 188 and 192 and the perimeter wall 202 of the first section 108. Slots 204 and 206 in the ribs 188 and 192, respectively, support and hold the first contact 110 in the second section 106 of the housing 104. Slots 208 and 210 in the ribs 188 and 192, respectively, support and hold the second contact 112 in the second section 108 of the housing 104. The rib 190 provides additional support to hold the second contact 112 in the second section 108 of the housing 104. Although, the rib 190 is optional and may be excluded.

A guide wall 212 supports and holds an end of the optional ground contact 134 in the second section 108 of the housing 104. An end of the ground contact 134 is placed inside the guide wall 212 so that an end of the ground contact is surrounded by the guide wall and a portion of the perimeter wall 202.

A groove 214 in the rib 188 supports an end of the cam 122. A key lock assembly aperture 216 in the perimeter wall 202 supports and holds the key lock assembly 116 in the second section 108 of the housing 104. The perimeter wall 202 also has a connector aperture 218 through which the electrical connector 132 is placed and secured in the housing 104. It will be appreciated that if the electrical connector 132 is not used in an embodiment of the invention, and, instead, the plug 126 is mounted or molded into the housing 104, the aperture 218 shall be modified to support the plug.

Grooves 220–228 matingly engage with the tabs 178–186 of the first section 106 (see FIG. 5) to secure the first section to the second section 108 of the housing 104. Optionally, a glue, epoxy, or other adhering material may be used to facilitate the secure engagement of the first section 106 with the second section 108. Alternately, screws or other connectors may be used to secure the first section 106 to the second section 108. Also, the grooves 220–228 and tabs 178–186 may be formed to snap-fit together.

FIGS. 8–11 illustrate more detailed views of the cam 122. The cam has a hole 230 and a seat 232 that engage the cylinder 120 of the key lock assembly 116. The hole 230 and inner shaft 234 are clamped to the cylinder 120 so that the rim 236 of the cam 122 resides on the outside of the cylinder housing 118.

A cam support 238 is supported and held between the first section 106 and the second section by the grooves 172 and 214, respectively. The cam 122 rotates freely within the grooves 172 and 214. Two arms 240 and 242 are provided along a longitude axis of the outer shaft 244 of the cam 122, and a lug 246 is provided on the rim 236 of the cam 122. The cam 122 can have other structures or other shaped structures in place of the arms 240 and 242 or another structure or anther shaped structure in place of the lug 246 that may provide the same functions of the arms and the lug as described more fully below.

The cam 122 can be made of any suitable material, such as a plastic or fiber glass material. Preferably, the cam 122 is made of an insulating or other electrically non-conducting material. However, the cam 122 may be made of a conducting material having an insulting or non-conducting outer layer. Preferably, the cam 122 may be molded as a single plastic piece from a form.

Figures 8, 9, 10, 11, 12, 13, 14:
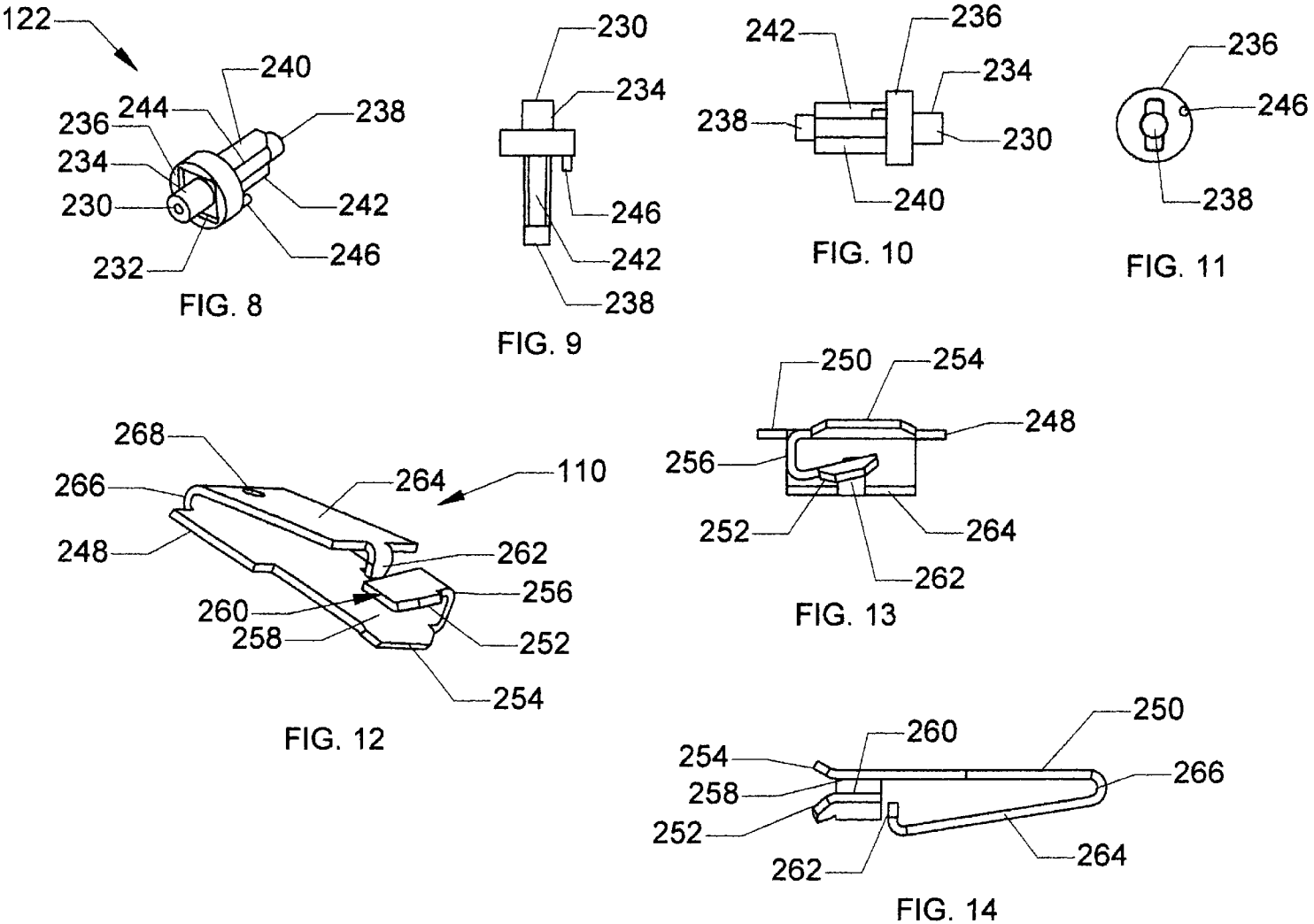
FIG. 8 is a perspective view of a cam of the power control device of FIG. 1.
FIG. 9 is a rotated view of the cam of FIG. 8.
FIG. 10 is a rotated view of the cam of FIG. 8.
FIG. 11 is a rotated view of the cam of FIG. 8.
FIG. 12 is a perspective view of a first contact and a second contact of the power control device of FIG. 1.
FIG. 13 is a rotated view of the contact of FIG. 12.
FIG. 14 is a rotated view of the contact of FIG. 12.

FIGS. 12–14 illustrate detailed views of the first contact 110. It will be appreciated that the first contact 110 and the second contact 112 are the same components. Therefore, each of the first contact 110 and the second contact 112 are identified in FIGS. 12–14. Although, reference will only be made to the first contact 110.

The contact 110 has contact supports 248 and 250 to support and hold the contact in the housing 104. Angled guides 252 and 254 connected by a bend 256 facilitate placement of the prongs 138 of an electrical device plug 136 (see FIG. 1) in engagement with the contact points 258 and 260 of the first contact 110. A locking tip 262 connected to a locking arm 264 is used to lock the electrical device plug 136 into the housing. Each locking tip 262 may be placed into the hole or aperture of one of the prongs 138 of the electrical device plug 136 to lock the electrical device plug into the housing 104. Preferably, the locking tip 262 is angled or pointed, such as V-shaped, to more easily facilitate its placement and engagement in the hole or aperture of one of the prongs 138.

The contact support 248 and the locking arm 264 are formed with a bend 266. Thus, the first contact 110 may be formed from a single pressed or cut element and formed in the manner provided in FIGS. 12–14. The first contact 110 may contain a connector aperture 268 for connecting one of the leads in the electrical connector 132 or from the plug 126 to the contact. The lead may be connected to the connector aperture 268 by a weld, solder, or another method. Alternately, the lead from the electrical connector 132 or from the plug 126 may be welded, soldered, or otherwise connected to the first contact 110 directly. Thus, the connector aperture 268 is optional.

The first contact 110 may be made of any suitable conducting material. Preferably, the first contact 110 is made from copper. Alternately, the contact 110 may be made of a non-conducting material so long as the contact points 258 and 260 are made of a conducting material and are connected to the lead of the electrical connector 132 or the plug 126 by a conducting material. The shape of the contacts 110 and 112 may be different. For example, the locking arm 264 may be more narrow.

Figure 16:
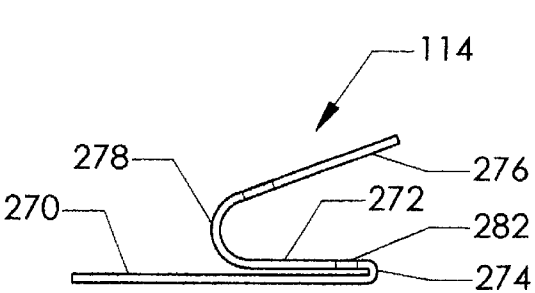
FIG. 16 is a rotated view of the third contact of FIG. 15.
Figure 15:
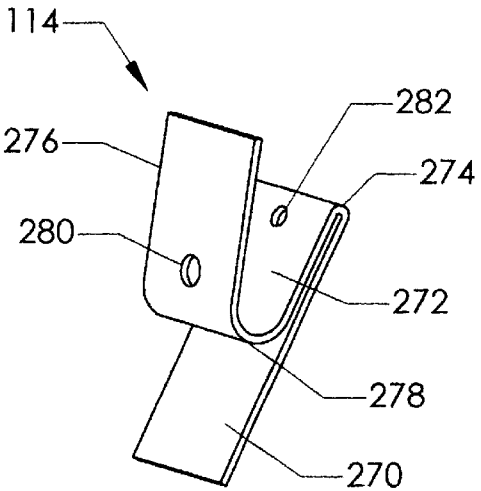
FIG. 15 is a perspective view of a third contact of the power control device of FIG. 1.

FIGS. 15 and 16 illustrate more detailed views of a third contact 114. The third contact 114 is U-shaped and has a support 270 connected to a terminal arm 272 by a bend 274. A lever arm 276 is connected to the terminal arm 272 by a seat 278.

Optionally, the third contact 114 may have a connector aperture 280 and a terminal aperture 282. The connector aperture 280 may be used to weld, solder, or otherwise connect a lead from the electrical connector 132 or plug 126 (see FIG. 1) to the third contact 114. Alternately, the lead from the electrical connector 132 or plug 126 may be connected directly to the lever arm 276 by a weld, solder, or other connection. Likewise, a terminal, such as the terminal of FIG. 19, may be located in the terminal aperture 282. The terminal may be connected to the terminal aperture 282 by a weld, solder, or other connection. Alternately, a weld, solder, or other conducting material may be located on the terminal arm 272. The terminal, weld, solder, or other conducting material facilitates connection of the third contact 114 and the second contact 112. However, the terminal, weld, solder, or other connection is optional.

The third contact 114 may be made of any suitable conducting material. Preferably, the third contact 114 is made of copper. However, the third contact 114 may be made of a non-conducting material if the terminal or other terminal point or contact point on the terminal arm 272 is made from a conducting material and the terminal or contact point is connected to the lead of the electrical connector 132 or plug 126 by a conducting material. The third contact 114 may be a different shape. For example, the support 270, the contact arm 272, or the lever arm 276 may be more narrow or "I" shaped.

Figure 18:
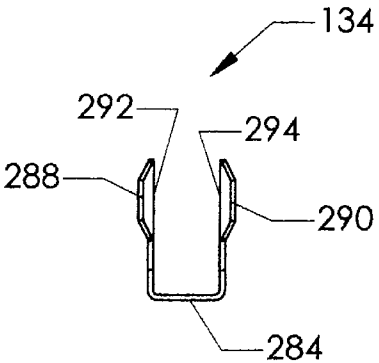
FIG. 18 is a rotated view of the ground contact of FIG. 17.
Figure 17:
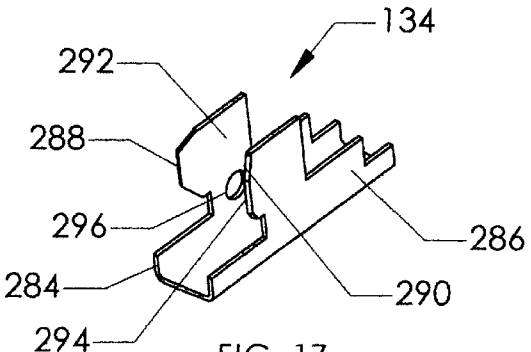
FIG. 17 is a perspective view of a ground contact of the power control device of FIG. 1.

FIGS. 17 and 18 illustrate more detailed views of the ground contact 134. The ground contact 134 has a first U-shaped leg 284 and a second U-shaped leg 286. Two angled guides 288 and 290 facilitate the placement of a ground prong in engagement with contact points 292 and 294. The ground contact 134 has an optional ground connector aperture 296 which may be used to connect a ground lead from the electrical connector 132 or plug 126 (see FIG. 1). The ground lead may be connected through the ground connector aperture 296 with a weld, a solder, or other connection method. Alternately, the ground lead may be connected directly to a conducting portion of the ground contact 134 by a weld, a solder, or other connecting method. For example, the ground lead may be welded or soldered to the angled guide 288.

The ground contact 134 may be made of any suitable conducting material. Preferably, the ground contact 134 is made of copper. Alternately, the ground contact 134 may be made of a non-conducting material so long as the contact points 292 and 294 are made of the conducting material and are connected to the ground lead of the electrical conductor 132 by a conducting material.

Figure 19:
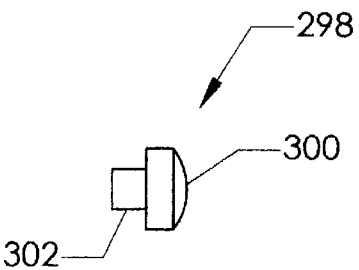
FIG. 19 is a side view of a terminal in accordance with an embodiment of the present invention.

FIG. 19 illustrates a detailed view of a terminal 298. The terminal has a head 300 and a shank 302. The terminal 298 may be made of a conductive material, such as copper. Alternately, any other conductive materials, such as a metal, may be used to form the terminal 298.

Referring to FIGS. 1, 2, 5, 8, 12, 15, and 17, the power control device 102 may be composed as follows. The supports 248 and 250 of the first contact are aligned in the slots 162 and 164 of the ribs 144 and 146. The support 270 of the third contact 114 is placed between the ribs 148 and 150. The supports of the second contact 112 are aligned in the slots 166 and 168 of the ribs 144 an 146. If the optional ground contact 134 is used, the second U-shaped leg 286 is aligned inside the guide wall 170 so that the second leg is located within the guide wall and the perimeter wall 160. It will be appreciated that the ribs, support walls, and perimeter walls of the first and second sections 106 and 108 insulate the contacts 110–114 and 134 from each other, when required, and other electrical conductors.

The leads of the electrical connector 132 are connected to the contacts 110, 114, and 134 as described above. Optionally, a terminal 298 is connected to the third contact 114 as described above. The electrical connector 132 is aligned in the connector aperture 176 so that the device plug 126 is on the exterior of the housing 104. A seal may be provided between the electrical connector 132 and the aperture 176.

The cam 122 is engaged in the cylinder housing 118 as described above. The cylinder housing 118 is placed in the key lock assembly aperture 174 of the first section 106. A seal can be provided between the cylinder housing 118 and the aperture 174. The cam support 238 of the cam 122 is supported on the groove 172 of the first section 106.

The second section 108 of the housing 104 is matingly engaged with the first section 106 so that the tabs 178–186 of the first section engage the grooves 220–228 of the second section. The slots 204 and 206 of the ribs 188 and 192 align with the contact supports 248 and 250 of the first contact 110. The slots 208 and 110 of the ribs 188 and 192 align with the contact supports of the second contact 112. The first U-shaped leg 284 of the optional ground contact 134 is aligned within the guide wall 212 so that the first leg is within the guide wall and the perimeter wall 202. The cam support 238 is aligned with the groove 214 of the second section 108.

The cylinder housing 118 is aligned with the key lock assembly aperture 216. The electrical connector 132 is aligned through the connector aperture 218.

Referring again to FIGS. 1, 2, 5, 8, 12, 15, 17, 20, and 21 the power control device 102 operates as follows. The plug 126 of the power control device 102 is plugged into an electrical receptacle (not shown), and an electrical device plug 136 is plugged into the receptacle 142 of the housing 104. The prongs 138 are directed by the angled guides 252 and 254 of the first contact 110 and the second contact 112 to the contact points 258 and 260 of the first and second contacts.

It will be appreciated that the length of the prongs 138 and 140 are approximately a standard known length. In addition, the diameter of the apertures in the prongs 138 are approximately a standard known diameter. Therefore, the second section 108 of the housing 104 and the configuration of the first and second contacts 110 and 112 within the housing 104 have such dimensions that the aperture of the prongs 138 will approximate adjacent the locking tip 262 of the respective first and second contacts such that the locking tips may be directed into the aperture of the prongs, i.e. engage the apertures of the prongs. The angle of the locking tip 262 facilitates the locking tip being directed into the aperture of the prongs 138. At this point, the prongs 138 are in electrical connection with the contact points 258 and 260 of the respective first and second contacts 110 and 112.

In addition, the ground prong 140 of the electrical device plug 136 are directed by the angled guides 288 and 290 of the ground contact 134 to the contact points 292 and 294. Thus, the ground prong 140 of the electrical device plug 136 will be an electrical connection with the contact points 292 and 294 of the ground contact 134.

Figure 21:
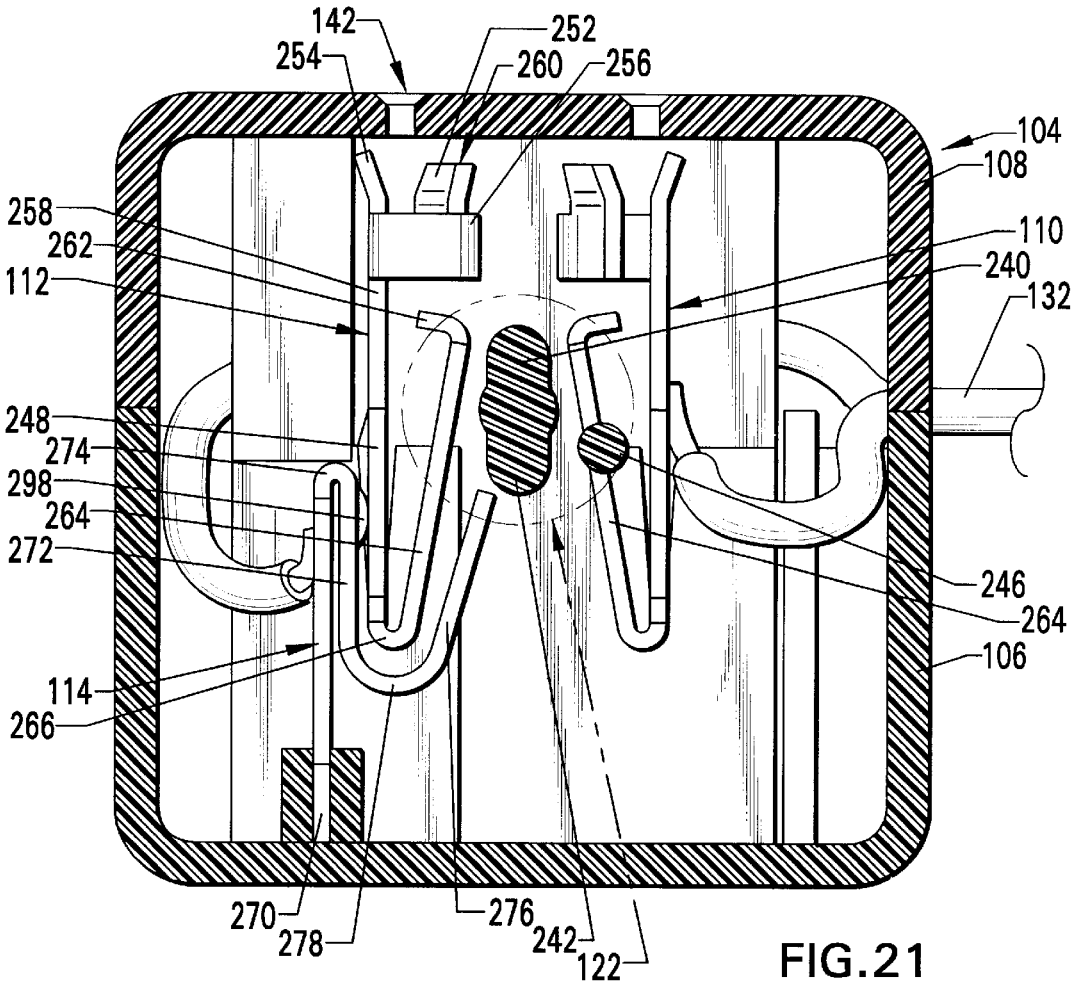
FIG. 21 is a cross sectional view of the power control device of FIG. 1 with the cam not operating on the third contact.

In a first example, the power control device 102 enables current flow between the contacts 110–114. In this example, the arms 240 and 242 of the cam 122 are oriented as illustrated in FIGS. 1 and 21. In this orientation, the arms 240 and 242 of the cam 122 do not operate on the locking arms 264 of the first and second contacts 110 and 112 and do not cause the locking tip 262 to engage the aperture of the prongs 138 of the electrical device plug 136. Although, the arms 240 and 242 of the cam 122 may be in contact with the locking arm 264 of the first and second contacts 110 and 112. In addition, in this orientation, the lug 264 of the cam 122 does not operate on the lever arm 276 of the third contact 114 and does not cause an interruption in the current path between the second contact 112 and the third contact 114. Although, the lug 264 of the cam 122 may be in contact with the lever arm 276 of the third contact 114.

An electrical circuit is created between the first contact 110, the second contact 112, and the third contact 114. Since the prongs 138 of the electrical device plug 136 are in electrical connection with the first contact 110 and the second contact 112, since the second contact is in electrical connection with the third contact 114, and since the first and third contacts are electrically connected to the leads of the electrical connector 132, a circuit is created there between, and current flows to the electrical device plug. This orientation shall be referred to herein alternatively as the on-condition, the cam 122 is axially-aligned, or the cam is in non-engaged alignment with the contacts 110–114.

As used herein, to "operate" means to apply a force to a component or to otherwise move a component. To "not operate" means to not apply a force to, or to remove a force from, a component or otherwise allow a component move as required for context.

However, "operate" may be used interchangeably with "not operate" herein and in the claims, and the meaning shall be easily determinable by one skilled in the art by context to mean either to apply force to, to not apply force to, to not remove force from, or to remove a force from a component. For example, if a lug is said to operate on a third contact to move the third contact into electrical connection with the second contact and out of electrical connection with the second contact, then "operate" means to remove force of the lug from, or remove contact of the lug with, the third contact to allow the third contact to be in, or to move into, electrical connection with the second contact, and "operate" means to apply a force on the third contact to move the third contact out of electrical connection with the second contact. Moving a component can be achieved by applying a force to that component or by removing a force from that component.

For example, the arm 240 of the cam 122 initially can be in a position so that it either is or is not in contact with the locking arm 264, but that it does not apply a force to the locking arm to cause the locking arm to move in a direction that causes the locking tip to move into, i.e. engage, an aperture of the prongs 138 of the plug 136. The arm 240 of the cam 122 can apply a force to the locking arm 264 to cause the locking arm to move in a direction that causes the locking tip 262 to move into an aperture of the prongs 138 of the plug 136. The arm 240 of the cam 122 then does not have to apply further force to the locking arm 264 but not remove force from the locking arm to cause the locking arm to remain in the location in which the locking tip 262 is in the aperture of the prongs 138 of the plug 136. Alternately, the arm 240 of the cam 122 can remove the force from the locking arm 264 so that the locking arm either is caused to move or is allowed to move in a direction that causes the locking tip 262 to move out of, i.e. disengage, the aperture of the prongs 138 of the plug 136.

The arm 240 of the cam 122 can then not remove further force from the locking arm 264 but not apply force to the locking arm to cause the locking arm to remain in the location in which the locking tip 262 is out of the aperture of the prongs 138 of the plug 136. The concepts from these examples apply similarly to the lug 246 operating or not operating on the lever arm 276 of the third contact 114 to cause the third contact to move in a direction, to remain in a location, to allow or cause the third lever to move in another direction, or to remain in another location.

In a second example, the power control device 102 operates to disable current flow to the electrical device plug 136. In this example, a key (not shown) is inserted into the key opening 124 of the key lock assembly 116. The key is rotated so that the cylinder 120 is rotated, thereby rotating the cam 122. The arms 240 and 242 of the cam 122 operate on the locking arm 264 of the first and second contacts 110 and 112 to cause the locking tip 262 to engage, i.e. enter, the aperture of the prongs 138 of the electrical device plug 136. This causes the locking tip 262 to lock the prongs 138 of the electrical device plug 136 inside the housing 104. See FIGS. 1 and 20.

Simultaneously, the lug 246 of the cam 122 operates on the lever arm 276 of the third contact 114. Because the structure of the third contact 114 is somewhat rigid, the force from the lug 246 on the lever arm 276 causes the terminal arm 272 to move out of contact and out of engagement with the second contact 112. Therefore, a circuit is not existent between the second contact 112 and the third contact 114, and current does not flow between the second contact and the third contact. Thus, power is not supplied to the prongs 138 of the electrical device plug 136. See FIGS. 1 and 20.

It can be seen that upon turning the key in the key lock assembly 116, thereby turning the cylinder 120 and the cam 122, the prongs 138 of the electrical device plug 136 are locked within the housing 104, and current flow between the contacts 110–114 is disabled. Since no current flows between all of the contacts 110–114, current does not flow to the prongs 138 of the electrical device plug 136. Therefore, no power is supplied to the electrical device plug 136. Moreover, the electrical device plug 136 may not be removed from the housing 104 of the power control device 102 because the prongs 138 are locked inside the housing by the locking tip 262 of the first and second contacts 110 and 112. The key may be removed from the key opening 124 so that the electrical device plug 136 is securely locked within the housing 104. This orientation is referred alternately herein as an off-condition, a non-axially aligned cam, or the cam is in engaged alignment with the contacts.

In a third example, the power control device 102 operates to enable current flow to the electrical device plug 136. In this example, power has been disabled, thereby not flowing to the electrical device plug 136. See FIGS. 1 and 20. To enable the current flow to the electrical device 136, a key (not shown) is inserted into the key opening 124 of the key lock assembly 116. The key is rotated so that the cylinder 120 is rotated, thereby rotating the cam 122. The arms 240 and 242 of the cam 122 rotate so that they do not operate on the locking arm 264 of the first and second contacts 110 and 112, thereby allowing the locking tip 262 of each of the first and second contacts to disengage, i.e. be removed from, the aperture of the prongs 138 of the electrical device plug 136. This causes the locking tip 262 to unlock the prongs 138 of the electrical device plug 136 so that the electrical device plug may be removed from the housing 104. See FIG. 21.

Simultaneously, the lug 246 of the cam 122 is moved away from the lever arm 276 of the third contact 114 so that the cam does not operate on the lever arm. Because the force from the lug 246 is removed from the lever arm 276, the terminal arm 272 of the third contact 114 moves into contact and into engagement with the second contact 112. Therefore, a circuit is existent between a second contact 112 and the third contact 114, and current flows between the second contact and the third contact. Thus, power is supplied to the prongs 138 of the electrical device plug 136. See FIG. 21.

It can be seen that upon further turning the key and the key lock assembly 116, thereby turning the cylinder 120 and the cam 122, the prongs 138 of the electrical device plug 136 are unlocked from the housing 104, and current flow between the contacts 110–114 is enabled. Since current flows between all of the contacts 110–114, current flows to the prongs 138 of the electrical device plug 136. Therefore, power is supplied to the electrical device plug 136. Moreover, the electrical device plug 136 may be removed from the housing 104 of the power control device 102 because the prongs 138 are not locked inside the housing by the locking tip 262 of the first and second contacts 110 and 112. Thus, the orientation is returned to the on-condition, alternately referred to as the axially aligned cam or that the cam is in engaged alignment with the contacts.

It will be appreciated that a key can be inserted into the key opening 124 and rotated in a first direction to orient the power control device to the on-condition. The key may be rotated in a second, preferably opposite, direction to orient the power control device to the off-condition.

A device may be constructed with the first contact 110 and the second contact 112, with or without the third contact 114, to provide a locking mechanism for a plug of an electrical device. In a first example, electrical leads are connected to the first and second contacts 110 and 112. Preferably, the cam 122 is not provided with a lug 246. Although, a lug 246 could be provided. The device then is operated as described above to lock the plug of the electrical device in the housing or to allow the plug of the electrical device to be removed from the housing.

Alternately, a device may be constructed so that the lug 246 operates to enable or disable power flow through the contacts 110–114, but there is no locking mechanism. In this example, the locking tip 262 and the arms 240 and 242 may not be required. Alternately, the device may be constructed so the arms 240 and 242 operate to enable or disable power flow through contacts 110–114, and the lug 246 then may not be required.

The structure of the housing, ribs, support walls and slots may be different. Although the first contact, the second contact, the third contact, and the cam should operate in any changed structure as specified.

Those skilled in the art will appreciate the variations from the specific embodiments disclosed above are contemplated by the invention. The invention should not be restricted to the above embodiments, but should be measured by the following claims.

What is claimed is:

1. A power control device comprising:

a first lead and a second lead configured to be electrically connected to an electrical source;

a first contact electrically connected to the first lead;

a second contact;

a third contact electrically connected to the second lead, the third contact comprising a terminal arm and a lever arm; and a cam configured to operate on the lever arm of the third contact to move the terminal arm of the third contact into electrical connection with the second contact and out of electrical connection with the second contact.

2. The power control device of claim 1 further comprising:

a key lock assembly adapted to rotate the cam between an on-condition in which the cam moves the third contact into electrical connection with the second contact and an off-condition in which the cam moves the third contact out of electrical connection with the second contact.

3. The power control device of claim 2 wherein:

the key lock assembly comprises a cylinder adapted to be rotated by a key and adapted to rotate the cam.

4. The power control device of claim 1 further comprising:

a housing containing the first contact, the second contact, the third contact, and the cam;

a plug; and an electrical connector comprising the first lead and the second lead, wherein the electrical connector is electrically connected to the plug outside of the housing.

5. The power control device of claim 1 further comprising a ground contact adapted to be electrically connected to the electrical source.

6. The power control device of claim 5 wherein the ground contact comprises angled guides.

7. The power control device of claim 1 wherein the first contact comprises angled guides and the second contact comprises angled guides.

8. The power control device of claim 1 wherein:

the first contact further comprises a first locking tip;

the second contact further comprises a second locking tip;

the first locking tip is adapted to engage a first aperture of an electrical device plug when the cam operates on the first contact and to disengage the first aperture when the cam does not operate on the first contact; and the second locking tip is adapted to engage a second aperture of the electrical device plug when the cam operates on the second contact and to disengage the second aperture when the cam does not operate on the second contact.

9. The power control device of claim 8 further comprising:

a housing containing the first contact, the second contact, the third contact, and the cam;

wherein the first locking tip and the second locking tip are adapted to lock the electrical device plug into the housing when the first locking tip engages the first aperture and the second locking tip engages the second aperture.

10. The power control device of claim 1 wherein:

the first lead and the second lead are adapted to receive electrical current and to transmit the electrical current between the first contact and the third contact;

the first contact is adapted to electrically connect to a first prong of an electrical device plug;

the second contact is adapted to electrically connect to a second prong of the electrical device plug; and the first contact and the second contact are adapted to transmit electrical current between the first prong and the second prong when the third contact is in electrical connection with the second contact.

11. The power control device of claim 10 wherein:

the first contact further comprises a first locking tip;

the second contact further comprises a second locking tip;

the first locking tip is adapted to engage a first aperture of the electrical device plug when the cam operates on the first contact and to disengage the first aperture when the cam does not operate on the first contact; and the second locking tip is adapted to engage a second aperture of the electrical device plug when the cam operates on the second contact and to disengage the second aperture when the cam does not operate on the second contact.

12. The power control device of claim 11 wherein:

the cam comprises a first cam arm adapted to operate on the first contact and a second cam arm adapted to operate on the second contact;

the first locking tip is adapted to engage the first aperture when the first contact is operated on by the first cam arm; and the second locking tip is adapted to engage the second aperture when the second contact is operated on by the second cam arm.

13. The power control device of claim 12 wherein:

the first contact comprises a first locking arm connected to the first locking tip;

the second contact comprises a second locking arm connected to the second locking tip;

the first cam arm is adapted to operate on the first locking arm;

the second cam arm is adapted to operate on the second locking arm;

the first locking tip is adapted to engage the first aperture when the first locking arm is operated on by the first cam arm; and the second locking tip is adapted to engage the second aperture when the second locking arm is operated on by the second cam arm.

14. The power control device of claim 1 wherein the cam comprises a lug adapted to operate on the third contact to move the third contact into electrical connection with the second contact and to not operate on the third contact to cause the third contact to move out of electrical connection with the second contact.

15. A power control device comprising:

a first contact comprising a first locking tip;

a second contact comprising a second locking tip; and a cam adapted to operate on the first contact and the second contact;

wherein the first locking tip is adapted to engage a first aperture of a first prong of an electrical device plug when the first contact is operated on by the cam and the second locking tip is adapted to engage a second aperture of a second prong of the electrical device plug when the second contact is operated on by the cam.

16. The power control device of claim 15 further comprising:

a key lock assembly adapted to rotate the cam between an on-condition in which the cam does not operate on the first contact and the second contact and an off-condition in which the cam operates on the first contact and the second contact.

17. The power control device of claim 16 wherein:

the key lock assembly comprises a cylinder adapted to be rotated by a key and adapted to rotate the cam between the on-condition and the off-condition.

18. The power control device of claim 15 further comprising:

a housing containing the first contact, the second contact, and the cam;

a plug; and an electrical connector comprising at least a first lead electrically connected to the first contact, wherein the electrical connector is electrically connected to the plug outside of the housing.

19. The power control device of claim 15 wherein:

the first contact comprises angled guides and the second contact comprises angled guides.

20. The power control device of claim 15 further comprising:

a first lead and a second lead adapted to be electrically connected to an electrical source; and a third contact electrically connected to the second lead;

wherein the first contact is electrically connected to the first lead; and wherein the cam further is adapted to operate on the third contact to move the third contact out of electrical connection with the second contact and to not operate on the third contact to cause the third contact to be in electrical connection with the second contact.

21. The power control device of claim 20 wherein:

the first lead and the second lead are adapted to receive electrical current and to transmit the electrical current between the first contact and the third contact;

the first contact is adapted to electrically connect to the first prong;

the second contact is adapted to electrically connect to the second prong; and the first contact and the second contact are adapted to transmit electrical current between the first prong and the second prong when the third contact is in electrical connection with the second contact.

22. The power control device of claim 21 wherein:

the cam comprises a first cam arm adapted to operate on the first contact and a second cam arm adapted to operate on the second contact;

the first locking tip is adapted to engage the first aperture when the first contact is operated on by the first cam arm; and the second locking tip is adapted to engage the second aperture when the second contact is operated on by the second cam arm.

23. The power control device of claim 22 wherein:

the first contact comprises a first locking arm connected to the first locking tip;

the second contact comprises a second locking arm connected to the second locking tip;

the first cam arm is adapted to operate on the first locking arm;

the second cam arm is adapted to operate on the second locking arm;

the first locking tip is adapted to engage the first aperture when the first locking arm is operated on by the first cam arm; and the second locking tip is adapted to engage the second aperture when the second locking arm is operated on by the second cam arm.

24. A power control device comprising:

a first lead and a second lead adapted to be electrically connected to an electrical source;

a first contact electrically connected to the first lead;

a second contact;

a third contact electrically connected to the second lead; and a cam adapted to rotate and comprising a lug, wherein the lug is adapted to operate on the third contact to move the third contact into electrical connection with the second contact and to not operate on the third contact to cause to third contact to be in electrical connection with the second contact when the cam is rotated.

25. The power control device of claim 24 further comprising:

a key lock assembly adapted to rotate the cam between an off-condition in which the cam moves the third contact out of electrical connection with the second contact and an on-condition in which the cam causes the third contact to be in electrical connection with the second contact.

26. The power control device of claim 25 wherein the key lock assembly comprises a cylinder adapted be rotated by a key and adapted to rotate the cam.

27. The power control device of claim 24 further comprising:

a housing containing the first contact, the second contact, the third contact, and the cam;

a plug; and an electrical connector comprising the first lead and the second lead, wherein the electrical connector is electrically connected to the plug outside of the housing.

28. The power control device of claim 24 further comprising a ground contact adapted to be electrically connected to the electrical source.

29. The power control device of claim 28 wherein the ground contact comprises angled guides.

30. The power control device of claim 24 wherein the first contact comprises angled guides and the second contact comprises angled guides.

31. The power control device of claim 24 wherein:

the first contact further comprises a first locking tip;

the second contact further comprises a second locking tip;

the first locking tip is adapted to engage a first aperture of an electrical device plug when the cam operates on the first contact and to disengage the first aperture when the cam does not operate on the first contact; and the second locking tip is adapted to engage a second aperture of the electrical device plug when the cam operates on the second contact and to disengage the second aperture when the cam does not operate on the second contact.

32. The power control device of claim 24 wherein:

the first lead and the second lead are adapted to receive electrical current and to transmit the electrical current between the first contact and the second contact;

the first contact is adapted to electrically connect to a first prong of an electrical device plug;

the second contact is adapted to electrically connect to a second prong of the electrical device plug; and the first contact and the second contact are adapted to transmit electrical current between the first prong and the second prong when the third contact is in electrical connection with the second contact.

33. The power control device of claim 32 wherein:

the first contact further comprises a first locking tip;

the second contact further comprises a second locking tip;

the first locking tip is adapted to engage a first aperture of the electrical device plug when the cam operates on the first contact and to disengage the first aperture when the cam does not operate on the first contact; and the second locking tip is adapted to engage a second aperture of the electrical device plug when the cam operates on the second contact and to disengage the second aperture when the cam does not operate on the second contact.

34. The power control device of claim 33 further comprising:

a housing containing the first contact, the second contact, the third contact, and the cam;

wherein the first locking tip and the second locking tip are adapted to lock the electrical device plug into the housing when the first locking tip engages the first aperture and the second locking tip engages the second aperture.

35. A power control device comprising:

a first contact comprising a first locking arm connected to a first locking tip;

a second contact comprising a second locking arm connected to a second locking tip; and a cam adapted to rotate comprising a first cam arm adapted to operate on the first locking arm when the cam is rotated and a second cam arm adapted to operate on the second locking arm when the cam is rotated, wherein the first locking tip is adapted to engage a first aperture of an electrical device plug when the first cam arm operates on the first locking arm and the second locking tip is adapted to engage a second aperture of the electrical device plug when the second cam arm operates on the second locking arm.

36. The power control device of claim 35 further comprising:

a key lock assembly comprising a cylinder adapted to rotate the cam between an on-condition in which the cam does not operate on the first locking arm and the second locking arm and an off-condition in which the cam operates on the first locking arm and the second locking arm.

37. The power control device of claim 35 further comprising:

a housing containing the first contact, the second contact, and the cam;

a plug; and an electrical connector comprising at least a first lead connected to the first contact, wherein the electrical connector is electrically connected to the plug outside of the housing.

38. The power control device of claim 35 further comprising:

a first lead and a second lead adapted to be electrically connected to an electrical source; and a third contact electrically connected to the second lead;

wherein the first contact is electrically connected to the first lead; and wherein the cam further comprises a lug adapted to operate on the third contact to move the third contact out of electrical connection with the second contact and to not operate on the third contact to cause the third contact to be in electrical connection with the second contact.

39. The power control device of claim 38 wherein:

the first lead and the second lead are adapted to receive electrical current and to transmit the electrical current between the first contact and the second contact;

the first contact is adapted to electrically connect to the first prong;

the second contact is adapted to electrically connect to the second prong; and the first contact and the second contact are adapted to transmit electrical current between the first prong and the second prong when the third contact is in electrical connection with the second contact.

40. A power control device comprising:

a first contact comprising a first locking tip; and a cam adapted to operate on the first contact;

wherein the first locking tip is adapted to engage a first aperture of an electrical device plug when the first contact is operated on by the cam.

41. The power control device of claim 40 further comprising:

a key lock assembly comprising a cylinder adapted to rotate the cam between an on-condition in which the cam does not operate on the first contact and an off-condition in which the cam operates on the first contact.

42. The power control device of claim 40 further comprising:

a housing containing the first contact and the cam;

a plug; and an electrical connector comprising a first lead electrically connected to the first contact, wherein the electrical connector is electrically connected to the plug outside of the housing.

43. A power control device comprising:

a first lead and a second lead adapted to be electrically connected to an electrical source;

a first contact electrically connected to the first lead and comprising a first locking arm connected to a first locking tip;

a second contact comprising a second locking arm connected to a second locking tip;

a third contact electrically connected to the second lead and comprising a lever arm;

a cam adapted to rotate comprising:

a first cam arm adapted to operate on the first locking arm when the cam is rotated:

a second cam arm adapted to operate on the second locking arm when the cam is rotated: and a lug adapted to operate on the lever arm of the third contact when the cam is rotated;

wherein:

the first locking tip is adapted to engage a first aperture of an electrical device plug when the cam arm operates on the first locking arm and to disengage the first aperture when the first cam arm does not operate on the first locking arm;

the second locking tip is adapted to engage a second aperture of the electrical device plug when the second cam arm operates on the second locking arm and to disengage the first aperture when the second cam arm does not operate on the first locking arm; and the lug is adapted to move the third contact out of electrical connection with the second contact when the lug operates on the lever arm and into electrical connection with the second contact when the lug does not operate on the lever arm.

* * * * *